US005732648A

United States Patent [19]

Aragon

[11] Patent Number: 5,732,648

[45] Date of Patent: Mar. 31, 1998

[54] LINE-HANDLING DEVICE

[76] Inventor: Ernest Quesada Aragon, P.O. Box 14782, Albuquerque, N. Mex. 87191

[21] Appl. No.: 508,955

[22] Filed: Jul. 31, 1995

[51] Int. Cl.[6] ..... B63B 21/16

[52] U.S. Cl. ..... 114/254; 242/904

[58] Field of Search ..... 114/253, 254; 242/390.1, 390.8, 390.9, 394, 394.1, 396.5, 396.9, 582, 583, 904, 125.1; 254/269, 362; 441/68, 69

[56] References Cited

U.S. PATENT DOCUMENTS

| | | | |
|---|---|---|---|
| 900,530 | 10/1908 | Harbour | 242/582 |
| 1,130,126 | 3/1915 | Wooden | 242/582 |
| 2,956,778 | 10/1960 | Weide et al. | 254/187 |
| 3,027,116 | 3/1962 | Holloway | 242/86.5 |
| 3,041,996 | 7/1962 | Roberts | 114/235 |
| 3,063,679 | 11/1962 | Nusbaum | 254/185 |
| 3,081,732 | 3/1963 | Breland | 114/235 |
| 3,098,463 | 7/1963 | Brown | 114/235 |
| 3,103,005 | 9/1963 | Hills | 441/69 |
| 3,232,555 | 2/1966 | Gorrell et al. | 242/86.5 |
| 3,315,914 | 4/1967 | Turner | 242/86.5 |
| 3,420,466 | 1/1969 | Sanders | 242/86.5 |
| 3,494,570 | 2/1970 | Jones, Jr. | 242/86.5 |
| 3,498,563 | 3/1970 | Palmieri | 242/86.5 |
| 3,638,876 | 2/1972 | Bullock | 242/106 |
| 3,831,545 | 8/1974 | Cain | 114/235 WS |
| 3,886,888 | 6/1975 | Parsons | 114/235 WS |
| 3,964,425 | 6/1976 | Septor, Sr. | 114/235 WS |
| 4,077,583 | 3/1978 | McGinnis | 242/85.1 |
| 4,098,213 | 7/1978 | McGinnis | 114/254 |
| 4,133,496 | 1/1979 | Zetah | 242/86.5 A |
| 4,220,293 | 9/1980 | Gename | 242/86.1 |
| 4,304,372 | 12/1981 | Smith et al. | 242/86.5 A |
| 4,429,839 | 2/1984 | Jessamine | 246/96 |
| 4,431,144 | 2/1984 | Foster | 242/85 |
| 4,960,065 | 10/1990 | Junkeris | 114/254 |
| 4,969,610 | 11/1990 | Taylor et al. | 242/86.5 A |
| 5,078,330 | 1/1992 | Hall | 242/86.52 |
| 5,238,200 | 8/1993 | Ritzenthaler | 242/86.5 A |
| 5,449,128 | 9/1995 | Crisci, Jr. | 242/583 |

*Primary Examiner*—Ed L. Swinehart

[57] ABSTRACT

A line-handling device mountable to an object such as a boat is disclosed. The device comprises a driven spool (3) on which a line may be stored coupling structure for coupling the line and the spool, and quick-connect structure disposed on the coupling structure for enabling the line and the spool to be quickly coupled or uncoupled at a distance from the spool. Coupling structure may include an elongated, flexible lead segment attached to the spool such that it may be wound thereon. The lead segment has the quick-connect structure disposed at its free end. The quick-connect structure enables the line and the lead segment to be quickly connected and disconnected, allowing the line to be quickly removed from the device so that it may be used independently. In one embodiment, a motor (10) is mounted within the spool's hub (83) and a slipping clutch (11) is connected between the motor and the spool.

22 Claims, 4 Drawing Sheets

LINE-HANDLING DEVICE

BACKGROUND OF THE INVENTION

The present invention relates generally to line reels and more particularly to reels for use in reeling and storing a water ski tow rope on a boat.

There exists a need among water skiers to eliminate a variety of problems associated with the management of the water ski rope. After use a ski rope is typically handled by paying it in "hand-over-hand" and stashing it somewhere in the boat. This sloppy method of rope handling leads to knots and tangles in the rope, delaying and making difficult the process of paying out the rope in an orderly manner when it is desired to water ski. This time delay also creates a safety hazard to a person who may be waiting in the water to receive the ski rope in an area having nearby boats. Even in the absence of tangles, the current process of manually paying out the rope is somewhat disorderly. The act of manually paying in a rope can itself also be a nuisance. Haphazard storage of the rope on the floor of the boat presents a further nuisance, and may also be a safety hazard to occupants of the boat. Furthermore, such storage may unduly shorten the life of the rope by unnecessarily exposing it to extra wear-and-tear as well as to the sun's ultraviolet rays.

Various concepts have been disclosed in the prior art that address some of the above problems. Manual winding devices do not solve all of the above problems, and still present inconvenience. Devices mounted to the exterior of the boat tend to be bulky, obtrusive, and generally unappealing.

Various designs have been disclosed in which the reel is mounted within the hull of the boat. The rope passes through an aperture in the hull as it is unwound and remains coupled to the reel during use. In most of these, the force of towing a skier is either supported by the device, or is transferred to the transom of the boat as by a rope-mounted stop member or a knot that abuts against the aperture's inner periphery. As such, these devices cause a departure from the traditional towing methods of attaching the tow rope to a boat-mounted tow ring, pylon, or bridle. This departure may be one reason why prior art of this form has suffered from a lack of consumer acceptance. These internally mounted prior art devices generally do not lend themselves to the convenient replacement of the tow rope with a different rope, as may be desired for a different skiing situation. Furthermore, their transom aperture is preferably limited to a central location. As such, these devices are not practical for use with outboard boats because of the presence of the outboard motor. Also, some of the prior art devices mounted within the boat hull tend toward excessive complexity relative to the current invention.

Additionally, in cases where the device supports the towing load, a very sturdy design is necessary. In cases where a stop member or knot supports the towing load, the device may require a transom that is strong enough at the aperture's location to support this force. This requirement may limit the type of boats on which such a device can be used. A stop member large enough to abut against the aperture's periphery also occupies precious space on a reel in which it is desired to minimize dimensions.

In two other cases, devices mounted within the boat hull are disclosed in which a lead portion of rope couples the ski rope to the reel while a skier is being pulled. The ski rope is anchored to a tow ring or a pylon while remaining coupled to the lead rope so that the reel is relieved of the towing load.

The lead portion of rope remains strung between the aperture and the towing hardware during skiing. Elimination of this lead portion may produce a safer and more appealing design.

Additionally, the first design uses a motor coupled to a positive clutch. This necessitates a sturdy design, as high winding tension can result if the spool is accidentally slowed or stopped while the motor is energized. This potential for high forces is also of concern because of possible injury or damage to nearby persons or objects. In the second design, the reel is spring driven and experiences an ever-present torque in the rope-rewinding direction. This is not conducive to the easy replacement of the rope.

Other concepts have been disclosed in which the rope is removed from the reel and used independently, favorably representing no departure from traditional towing methods. These designs have been either of a manual nature or externally mounted, with the incumbent difficulties.

The present invention enables orderly management and storage of a ski tow rope. It solves the outlined problems associated with handling of the rope and overcomes the problems described with the prior art. The present device may be unobtrusively fitted within a boat so that the rope may be fed out through a hull aperture. Its primary feature is a means for quickly removing the tow rope after payout for independent use.

The principal object of this invention is to provide a device mountable on a boat that enables orderly management and storage of a water ski tow rope, and which features a novel means for allowing the rope and its storage spool to be quickly coupled and uncoupled at a distance (i.e., at a location removed) from the spool, so that the rope may be used independently of the device. This feature has several advantages. It permits the device to be mounted within the boat while enabling water skiers to use the rope without departing from traditional ski towing methods. As such, this accessory may appeal to skiers who ski off a pylon, tow ring, or bridle, thereby maintaining broad the potential market. This "rope removability" feature also enables lightweight construction. It provides flexibility in the choice of aperture location. Furthermore, it allows the simple exchange of ropes should it be desired to store a different one.

An embodiment using a slipping clutch enhances safety by limiting winding forces, and also allows a simple, lightweight design. A favored embodiment features a simple design that is compact and easily assembled/disassembled. An optional feature allows the ski handle to be removed and neatly stored separately. The present device may be perceived as a desirable accessory that may be proudly mounted on a modern boat. By providing a consistent storage location, the device reduces the chance that a rope might be lost or left at home. Other objects and advantages will become apparent upon perusal of the following description of the present invention.

While the present invention is described in association with specific application to ski ropes, it is not necessarily limited to this use. In a broader aspect, the present invention provides a means by which a line and a line storage spool may be quickly coupled and uncoupled at a distance from the spool so that the line may be used independently of the spool. This feature may be useful in applications in which it is desired to use a spool separated from the operator to store a line that is to be repeatedly removed for independent use. The device allows the easy coupling and uncoupling of a line and a spool to which access would otherwise be restricted or inconvenient.

SUMMARY OF THE INVENTION

The line-handling device of the present invention may be mounted to an object such as a boat as may have an aperture in its hull through which a rope may pass. The device comprises a rotatable spool on which a line may be stored, coupling means attached to the spool for coupling the line and the spool, and quick-connect means disposed on the coupling means for enabling the line in its unwound state and the spool to be quickly and easily coupled or uncoupled at a distance from the spool. The coupling means may include an elongated, flexible lead segment, such as of line or strapping. The lead segment is attached at its proximal end to the spool such that it may be wound onto the spool. The quick-connect means is disposed at the distal end of the lead segment for enabling the line in its unwound state and the lead segment to be quickly connected and disconnected at a distance from the spool. The lead segment thus couples the line to the spool and the quick-connect means allows the line to be quickly uncoupled from the spool so that it may advantageously be used independently, and quickly re-coupled to the spool prior to winding. The quick-connect means may include a snap fastener mounted on the lead segment such that the distal tip of the lead segment may be releasably fastened to an area of the lead segment removed from this tip to form a loop sized so as to be able to retain the line. This tip may accordingly be passed through a loop in the proximal end of the line and the snap fastener closed to engage the loop. In one embodiment, a motor is mounted within the spool's hub and a slipping clutch is connected between the motor and the spool.

DETAILED DESCRIPTION OF THE INVENTION

Figure 1:
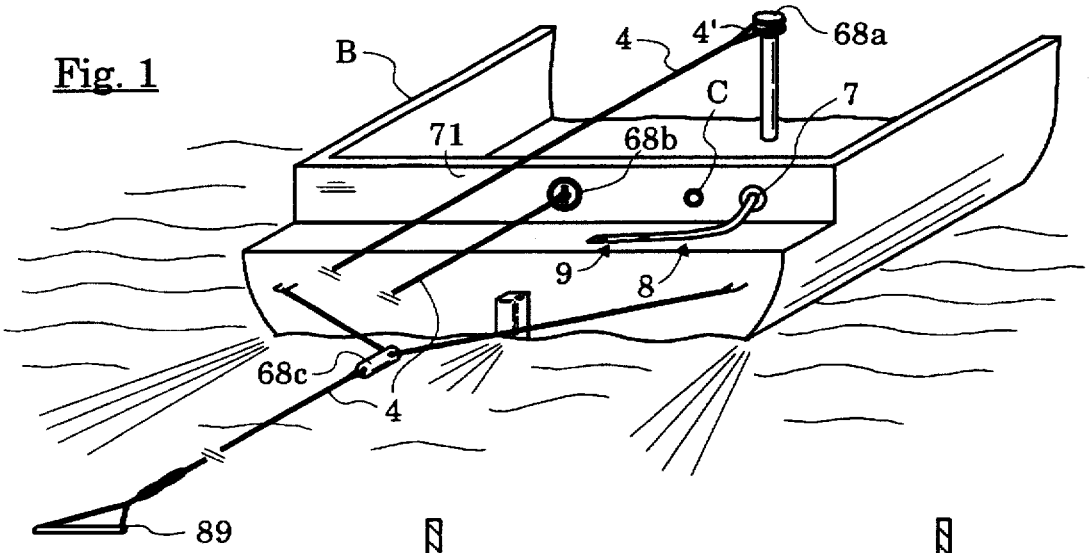
FIG. 1 is a diagrammatic representation of the rear portion of a boat showing the use of a tow rope on a boat within which the preferred embodiment of the present invention is mounted, in which the rope is removed from the invention and attached to a pylon, tow ring or bridle.
Figure 3:
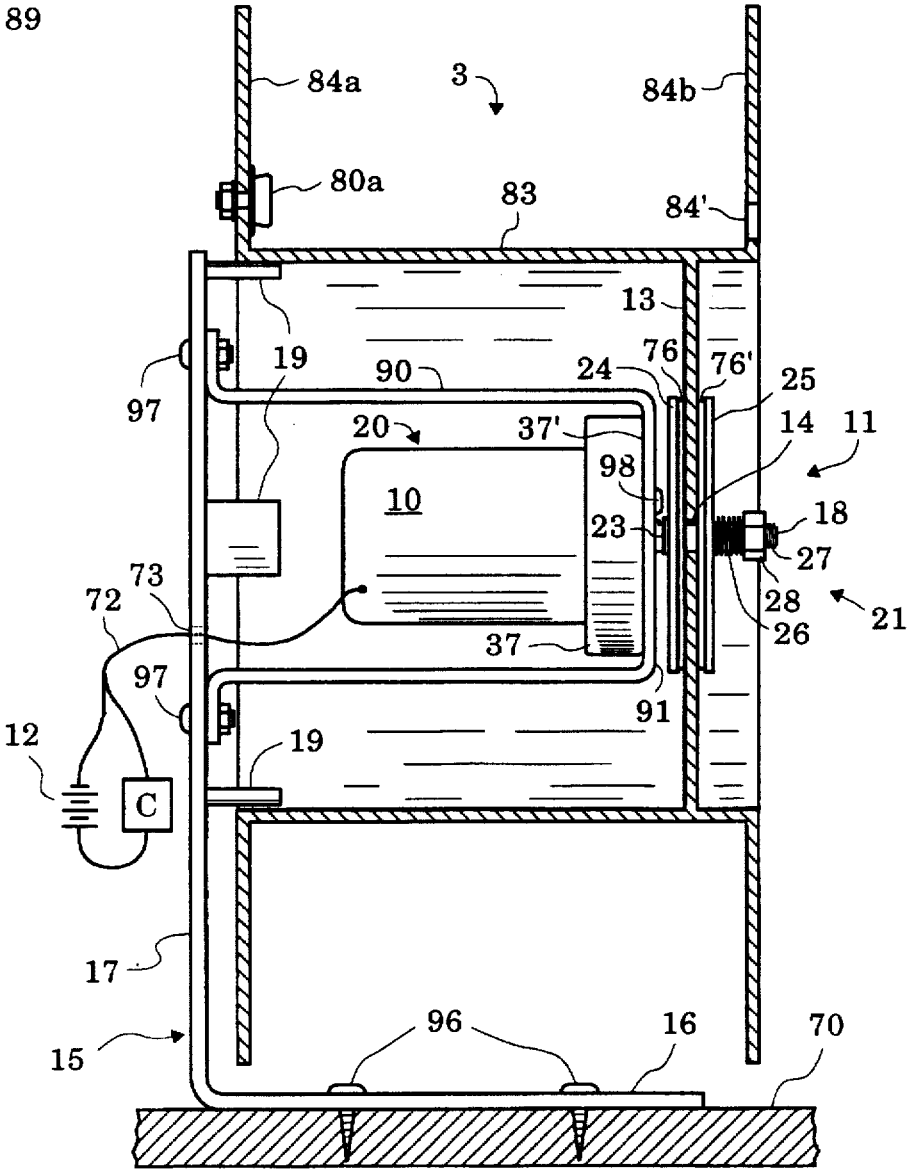
FIG. 3 is a side view of the reel assembly of the present invention with the spool in section.
Figure 2:
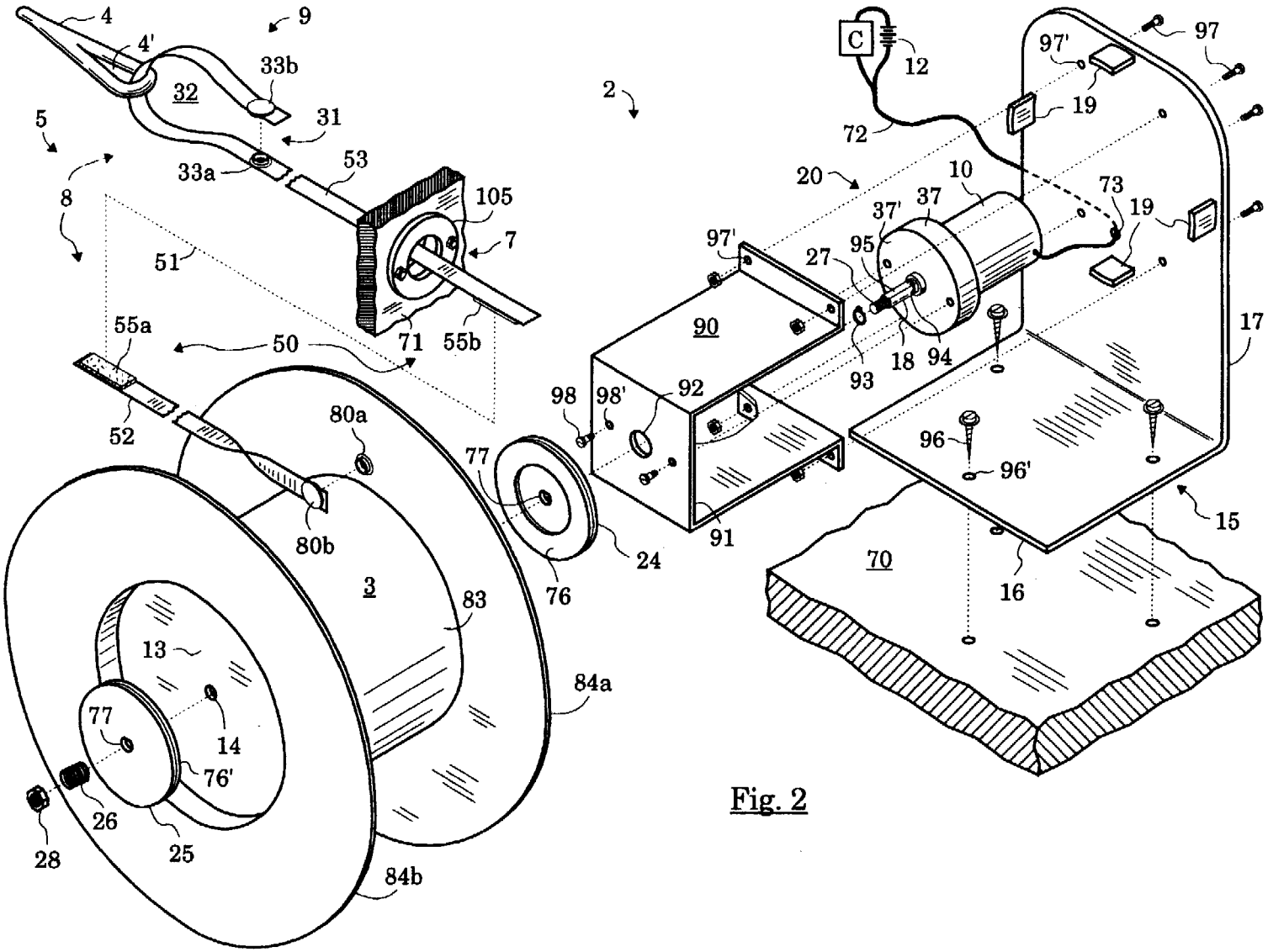
FIG. 2 is an exploded isometric view of the preferred embodiment of the present invention.

FIG. 1 illustrates the use of a water ski tow rope 4 and ski handle 89 on a boat B within which the preferred embodiment of the present line-handling device 2 is mounted. In this embodiment, rope 4 may be removed from device 2 and used in any manner desired, as by attaching it in a traditional manner to a boat-mounted pylon 68*a*, tow ring 68*b*, or bridle 68*c*, and towing a water skier. FIGS. 2 and 3 show exploded and side views of novel device 2, which includes a driven or rotatable spool 3 on which rope 4 may be stored. Spool 3 is rotatably mounted to a selected mount surface 70 within the hull of boat B (see also FIG. 14). An aperture 7 in the hull of boat B provides a passage through which rope 4 may pass from spool 3 to the exterior of boat B. FIG. 1 shows rope 4 as it is being used, having been unwound from spool 3 and removed from an elongated, flexible lead segment 8 that serves to removably couple rope 4 to spool 3. Referring to FIGS. 2 and 3, device 2 may include a motor 10 and a clutch connected between motor 10 and spool 3, such as a slipping clutch 11.

The terms "rope" and "line" may be used interchangeably in this description, with the latter having the more general meaning (e.g., rope, cord, cable, etc.).

In the preferred embodiment, spool 3 is hollow and includes a hub 83 and flanges 84*a* and 84*b*. Spool 3 has a substantially planar hub cover disk 13 attached to or integrally formed with spool 3 at or near the end of hub 83 that is adjacent to flange 84*b*, so that hub 83 is closed at or near this end and open at the other end. A round shaft-receiving hole 14 is positioned in the center of cover disk 13.

Motor 10 may be powered by a battery 12, and includes a speed reducing mechanism with an output shaft 18. The speed reducing mechanism may be a gearbox 37, thus forming a gearmotor 20. Mounting means may include a support panel 17 mountable to surface 70 within boat B. For example, a right-angle bracket 15 comprising a substantially planar base 16 and support panel 17 may be mounted to surface 70 by mount screws 96 passed through holes 96' in base 16. Motor 10 is mounted in any suitable manner to panel 17 such that the outer end of shaft 18 extends perpendicularly away from panel 17. In the present discussion of shaft 18 and its associated elements, the term "outer" denotes "in the direction away from motor 10" and the term "inner" denotes the opposite. Mounting of motor 10 may be facilitated by using a motor bracket 90 of any suitable shape (partially cut away in FIG. 2), which includes a panel 91 to which the face 37' of gearbox 37 may be attached. Panel 91 has a shaft clearance hole 92 allowing passage of shaft 18. Motor 10 may be mounted to motor bracket 90 by motor bolts 98, which pass through holes 98' in panel 91 and are fastened to face 37' of gearbox 37. The combined assembly of gearmotor 20 and motor bracket 90 may be fastened to panel 17 as by fastening bracket bolts 97 through suitably located holes 97' in panel 17 and motor bracket 90. Lead wires 72 connect motor 10 to battery 12 and any conventional control means C. Control means C may be a simple switch mounted in a convenient location, as on the boat's transom wall 71 (see FIG. 1) or dashboard. Lead wires 72 may be passed away from motor 10 through a hole 73 in panel 17.

Panel 17 also supports a set of spool bearings 19 that provide curved bearing surfaces extending substantially perpendicularly from panel 17. Bearings 19 may be separate parts attached to panel 17 or may be integrally formed with panel 17. Bearings 19 are positioned so as to provide suitable bearing surfaces on which the open end of spool 3 may ride. The open end of spool 3 is rotatably mounted onto bearings 19 and the closed end of spool 3 is journaled onto shaft 18, which protrudes through shaft-receiving hole 14. When spool 3 is thusly mounted, motor 10 is positioned within hub 83 of spool 3 and the axis of rotation of spool 3 is perpendicular to panel 17.

Figure 4:
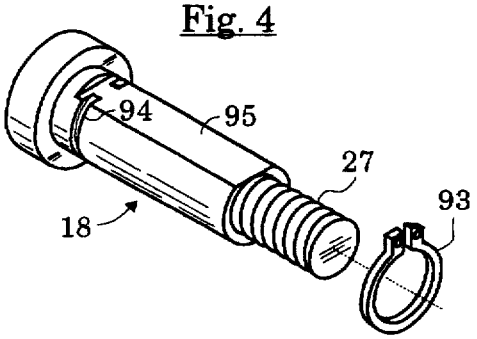
FIG. 4 is an enlarged, exploded view of a shaft assembly including a retaining ring for mounting on the shaft.

Prior to mounting spool 3 as described above, an inner friction disk 24 is slidably mounted onto shaft 18 in a manner such that disk 24 is rotationally fixed to shaft 18. Disk 24 may have a D-shaped hole 77 in its center and shaft 18 may have a flat 95 such that disk 24 may axially slide onto and remain rotationally fixed to shaft 18. Alternatively, shaft 18 may be splined and hole 77 similarly shaped. Inner disk 24 has a friction lining 76 on one side, and is mounted such that lining 76 faces away from motor 10. As shown in FIG. 3, shaft 18 also includes a shoulder 23 located near its inner end providing a limiting surface against which inner disk 24 abuts. Shoulder 23 may be integrally formed with shaft 18. Shoulder 23 may alternatively be formed by an external retaining ring 93 fitted into a retaining ring groove 94 formed in shaft 18, as shown in FIGS. 2 and 4.

Referring again to FIGS. 2 and 3, spool 3 may then be mounted as described above onto bearings 19 and shaft 18 such that the inside surface of hub cover disk 13 contacts friction lining 76 on inner disk 24. An outer friction disk 25, identical to inner disk 24, is then similarly mounted onto shaft 18 such that its friction lining 76' contacts the outside surface of cover disk 13.

A compression spring element 26 is then mounted next to outer disk 25 by slipping it axially onto shaft 18. The combined assembly of spool 3, disks 24 and 25, and spring element 26, is axially secured in a removable manner onto shaft 18 by an axial-securing means 21 fastened onto the outer end of shaft 18. Axial-securing means 21 is adjustably positioned such that spring element 26 is compressed, causing there to be an adjustable pressure between disks 24 and 25 and cover disk 13. Axial-securing means 21 may take the form of a shaft locknut 28 that may be secured onto shaft screw threads 27 formed on the outer end of shaft 18. The diameter of threads 27 must be small enough to allow disks 24 and 25 to slide onto shaft 18. A nylon insert locknut generally provides a fastening that is loose enough to easily adjust while providing the necessary securement of the rotating assembly. A constantly engaged slipping clutch 11 is thus formed, in which slipping occurs at a given torque threshold. This threshold may be adjusted by changing the position of axial-securing means 21.

Slipping clutch 11 generally has two modes of operation: reeling mode and payout mode. In reeling mode, disks 24 and 25 rotate when gearmotor 20 is energized, frictionally urging spool 3 to rotate. Slipping clutch 11 will slip if an overload occurs, as may occur if rope 4 becomes snagged during winding or if spool 3 is otherwise prevented from rotating while gearmotor 20 is energized. In these instances, gearmotor 20 and disks 24 and 25 will continue rotating in opposition to the torque created by slippage against spool 3. High winding forces are thus prevented, thereby protecting gearmotor 20 from damage and generally protecting device 2 and anything else that might be damaged by high winding forces. Furthermore, this torque limitation enhances personal safety and allows a lightweight design. Gearmotor 20 is preferably designed to withstand continuous rotation against this slipping torque without overheating.

In payout mode, gearmotor 20 and slipping clutch 11 preferably remain stationary as rope 4 is manually reeled out. Spool 3 rotates against the opposing torque offered by slipping clutch 11, and is thereby prevented from freewheeling. To hold slipping clutch 11 stationary, gearmotor 20 is preferably designed to firmly resist backdriving when subjected to the threshold torque resulting from rope 4 payout. Slipping clutch 11 may alternatively be held stationary during payout by a mechanism that rotationally fixes disk 24 or disk 25. For example, a solenoid (not shown) may be mounted to motor bracket 90 such that its plunger selectively engages a hole in disk 24 so as to lock disk 24 in place during payout.

The torque threshold of slipping clutch 11 may be set high enough to provide sufficient torque to wind rope 4 in reeling mode, yet low enough to allow rope 4 to be easily unreeled in payout mode.

The motor-within-hub design described thus far is compact to conduce better fit within the confines of boats, and is easily assembled/disassembled. The example described also provides for spool 3 to be mounted to surface 70 such that the axis of rotation of spool 3 is parallel to surface 70. A survey of various boats indicates that this orientation may be conducive to the fit of device 2 within a larger percentage of boats than a perpendicular one.

Device 2 also includes coupling means 5 by which a line, such as rope 4, is coupled to spool 3, and a quick-connect means 9 disposed on coupling means 5 for enabling the line in its unwound state and spool 3 to be quickly and easily coupled or uncoupled at a distance (i.e., at a location removed) from spool 3, such as by the action of a quick fastening mechanism. The time consuming and cumbersome formation of a type of "Lark's Head in Eye" knot, standard for water-skiing use, is thus avoided. Coupling means 5 and quick-connect means 9 allow the line to be freed from spool 3 after unwinding, so that it may be used completely independently of device 2, and allow spool 3 to be mounted in a location separated from the operator, as by the hull. Coupling means 5 and quick-connect means 9 also serve to quickly and easily couple an unwound line to spool 3 to position the line for winding. Referring to FIGS. 1 and 2, coupling means 5 may include lead segment 8 as may be formed from one or more connected lengths of line and/or strap. The proximal end of lead segment 8 is attached to spool 3 such that segment 8 may be wound onto spool 3. In the present discussions of lead segment 8 and rope 4, the term "proximal" denotes "intended to be nearest to spool 3", and the term "distal" denotes "intended to be farthest from spool 3". The proximal end of lead segment 8 may have a snap socket **80*b* mounted thereon (see FIG. 2) for fastening to a snap stud 80*a* mounted on flange 84*a*, allowing lead segment 8 to be attached to spool 3 in a firm but easily removed manner. Lead segment 8 may alternatively be attached to hub 83 as by a bolt 81 fastened to an optional flat 82 (see FIG. 5) sufficiently distanced from flange 84*a* so as to avoid interference with bearings 19**.

In the favored embodiments of lead segment 8, quick-connect means 9 is disposed at the distal end of segment 8 such that the proximal end of rope 4 and segment 8 may be quickly connected and disconnected so that rope 4 may be easily uncoupled from spool 3 for independent use. In these embodiments, segment 8 and quick-connect means 9 are of a form so as to allow quick-connect means 9 to smoothly pass through and be presented out of aperture 7 within convenient reach of a person wishing to remove rope 4. Segment 8 may also have disposed thereon an overstress-prevention means 50 (see FIG. 2) for automatically protecting device 2, including spool 3 and the mounting means, from any accidental or damaging overstress that may occur at the conclusion of rope 4 payout, as may be caused by tension in segment 8. This feature allows lightweight construction of device 2.

Referring to FIG. 2, quick-connect means 9 preferably includes a loop closure 31 comprised of fastening elements by which a line-engaging loop 32 may be releasably formed at the distal end of lead segment 8. Loop closure 31 releasably fastens the distal tip of lead segment 8 to an area of segment 8 suitably removed from this tip such that the resulting line-engaging loop 32 is sized so as to be able to retain a loop 4' disposed on the proximal end of rope 4. Loop closure 31 may include first and second snap fastener elements, such as a snap socket **33*b* mounted to the distal tip of lead segment 8 and a mating snap stud 33*a* mounted to segment 8 at a location suitably removed from this tip. Snap socket 33*b* may thus be passed through loop 4' and fastened to snap stud 33*a* so as to form line-engaging loop 32 that retains loop 4' and releasably connects rope 4 to segment 8. Note that "peeling" of a snap fastener tends to unfasten it while forces in a "shearing" direction do not. When rope 4 tugs on line-engaging loop 32, shearing forces dominate the response of snap fastener 33. Snap fastener 33 thus allows rope 4 to be firmly connected to lead segment 8** for winding, yet easily removed for use.

Overstress-prevention means 50 may generally take the form of a reclosable fastening 51 of limited strength disposed on lead segment 8 such that the unfastening of reclosable fastening 50 causes rope 4 to become uncoupled from spool 3. The closure of reclosable fastening 50 is thus a necessary condition for rope 4 to be coupled to spool 3 in the manner described above. Reclosable fastening 51 is of a form such that the presence of tension in lead segment 8 induces a force tending to separate reclosable fastening 51. When payout of rope 4 is concluded, reclosable fastening 51 will automatically unfasten if the tension in lead segment 8 accidentally becomes too high for reclosable fastening 51 to withstand, allowing rope 4 to uncouple from spool 3, and relieving the tension. Device 2, including spool 3 and the mounting means, is thus protected from damaging stress. Reclosable fastening 51 separates only when necessary, and not as part of the ordinary use of device 2. Examples of reclosable fastening 51 are described in forthcoming descriptions of specific lead segment 8 embodiments.

Note that a further benefit of slipping clutch 11 may be realized when rope 4 is attached to lead segment 8 for winding. Should rope 4 be unduly restrained during the initial winding, slipping clutch 11 may limit the tension so as to prevent untimely separation of reclosable fastening 51 or damage to quick-connect means 9, as may be in the form of fastener elements 33.

Several variations of lead segment 8 are contemplated. The preferred embodiment of lead segment 8, shown in FIG. 2, is formed from two connected lengths of fabric strapping, as of woven polypropylene or nylon material. It includes a spool-attached "spool" strap 52 and a line-engaging "line" strap 53. The proximal end of spool strap 52 may be fixed to spool 3 as by snap socket **80*b* or bolt 81. Line strap 53 includes quick-connect means 9, such as snap fastener 33, at its distal end. The remaining ends of straps 52 and 53 may be connected by reclosable fastening 51, as may be in the form of adhering strips of hook-and-loop fastening material (e.g., VELCRO™). A strip of "hook" material 55*a* may be sewn to the distal end of spool strap 52 and a strip of "loop" material 55*b* may be sewn to the proximal end of line strap 53. Strips 55*a* and 55*b* may be joined so that straps 52 and 53 are connected in approximate alignment to form one lead segment 8. Strips 55*a* and 55*b* will shear apart if lead segment 8 accidentally experiences tension beyond a designed threshold, allowing the coupled combination of rope 4 and line strap 53 to separate from spool strap 52. Lead segment 8 may be easily re-assembled after such a separation by connecting straps 52 and 53** as described above.

Figure 5:
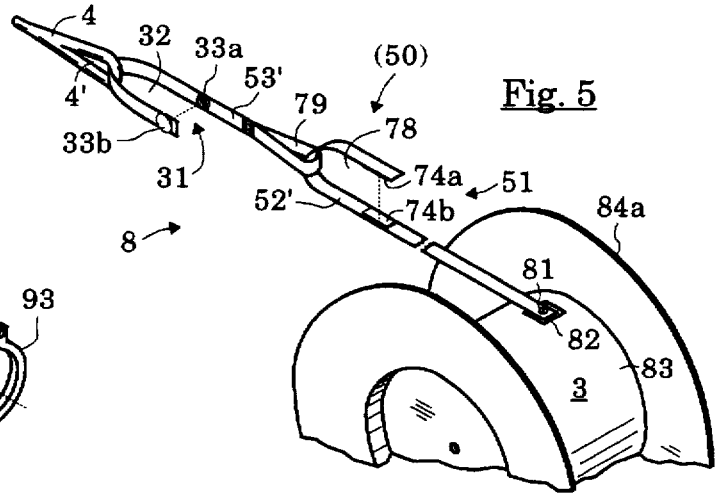
FIG. 5 is an isometric view of a second lead segment embodiment.

FIG. 5 illustrates a different embodiment of lead segment 8. A different version of line strap 53', which includes loop closure 31 toward its distal end, has a loop 79 sewn or otherwise formed in its proximal end. Reclosable-fastening 51 takes the form of a hook-and-loop fastener strip **74*a* mounted at the distal tip of an alternative spool strap 52' and a mating strip 74*b* mounted to an area suitably removed from this tip. A loop 78 may thus be releasably formed in spool strap 52' to engage loop 79 in a manner similar to that described above for line-engaging loop 32. Hook-and-loop fastener strips 74*a* and 74*b* will shear apart if lead segment 8 accidentally experiences tension beyond a designed threshold, releasing loop 78 and allowing the coupled combination of rope 4 and line strap 53' to separate from spool strap 52'**.

Figure 6:
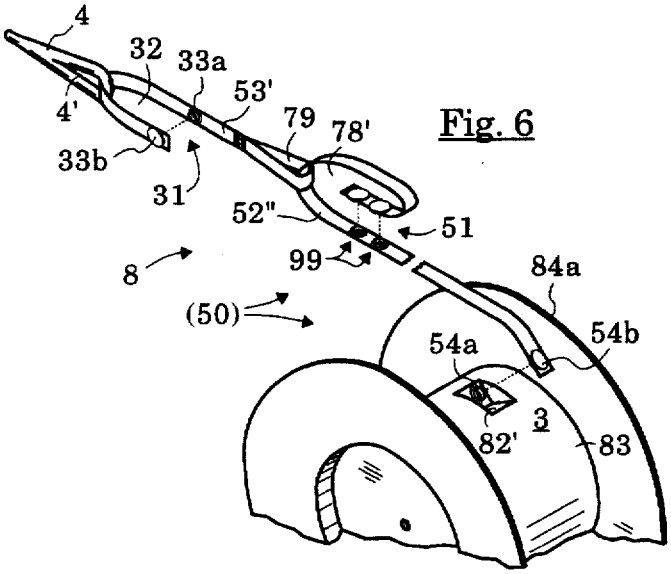
FIG. 6 is an isometric view of a third lead segment embodiment.

FIG. 6 shows a third embodiment of lead segment 8, which includes line strap 53' of the preceding embodiment. Reclosable fastening 51 is formed by a pair of adjacent snap fasteners 99 that close a loop 78' at the end of yet a different spool strap 52". Loop 78' releasably engages loop 79. The mating elements of fasteners 99 are arranged on opposite sides of strap 52" such that two folds of strap 52" are required to form loop 78', so that tension in lead segment 8 may induce peeling of fasteners 99 rather than shearing. Two fasteners 99 are used to maintain loop 78' properly oriented to insure this peeling action. A snap socket **54*b* on the proximal end of spool strap 52" is fastened to a hub-mounted stud 54*a*, 54*a* is mounted to an angled surface within a spool hub recession 82' distanced from flange 84*a* so as to avoid interference with bearings 19. The tendency of fastener 54 to unsnap under tension decreases with increased angle. The angle is large enough so that rising tension in lead segment 8 will cause fasteners 99 to peel open before fastener 54 unsnaps. This angle is not too large to preclude peeling of fastener 54 should loop 78' be formed incorrectly, in which case fastener 54 may unsnap as a backup protective mechanism. When device 2 is properly used so as to avoid tension in lead segment 8, fasteners 99 and 54** will remain intact.

Figure 7:
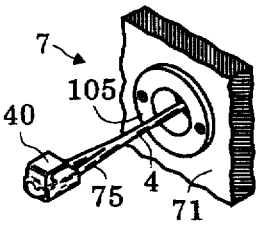
FIG. 7 is an isometric view of a hull-mounted eyelet as it is about to receive a stop member mounted to the distal end of the tow rope, illustrating their relative position as winding is almost completed and the ski handle has been removed.
Figure 8:
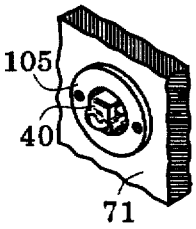
FIG. 8 is an isometric view illustrating the storage position of the stop member within the eyelet of FIG. 7.
Figure 15:
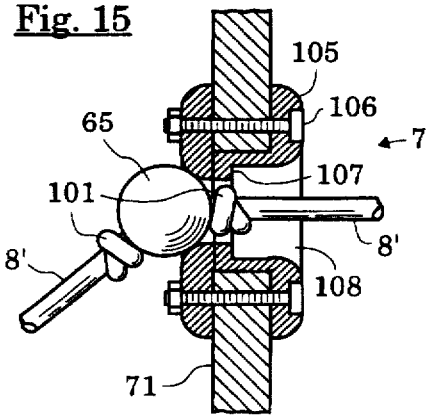
FIG. 15 is a sectional view showing a possible eyelet design, also illustrating its interaction with the load-bearing member of the embodiment shown in FIG. 14.

Aperture 7 in the hull of boat B is preferably of a form such that device 2 may work cooperatively with a stop member 40 that is mounted to the distal end of rope 4. For example, one possible stop member 40 is a rope fastener marketed as the QC Woggle™ (Straight Line Water Sports, Inc., Redmond, Wash., U.S. Pat. No. 5,033,169), shown in FIG. 7. This fastener is mounted to the loop 75 at the distal end of rope 4 to which ski handle 89 may be attached. Aperture 7 is preferably of a form such that stop member 40 abuts against the periphery of aperture 7 upon termination of winding, preventing complete retraction of rope 4 through aperture 7. This allows ski handle 89 to be removed and neatly stored separately if desired, so that it does not remain disposed out of aperture 7. FIG. 7 shows the disposition of member 40 after the removal of ski handle 89 and just prior to abutment. FIG. 15 details an example of aperture 7 as may be formed by a two-piece eyelet 105 fastened through transom wall 71 by bolts 106. Eyelet 105 includes a hollow outer entry 108 within which member 40 may be received, and a lip 107 recessed from the edge of entry 108, against which member 40 may abut. Lip 107 is recessed such that member 40 may fit substantially within entry 108 for an unobtrusive storage position, as shown in FIG. 8. The geometry of eyelet 105 should also be so as to facilitate easy grasping of member 40 to initiate rope 4 payout. Stop member 40 may be of any form capable of abutting against aperture 7 as described above.

Figure 9:
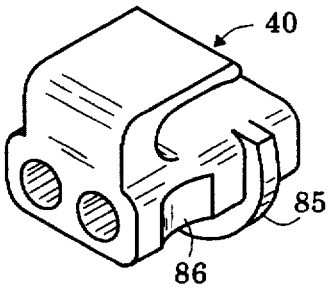
FIG. 9 is an isometric view illustrating contemplated modifications to the stop member of FIGS. 7 and 8.

FIG. 9 shows contemplated modifications to the QC Woggle™ that may enhance its cooperation with device 2. A flange 85 may provide for more effective seating against lip 107, and indentations 86 on each side of member 40 may facilitate easier grasping by a person.

Figure 10:
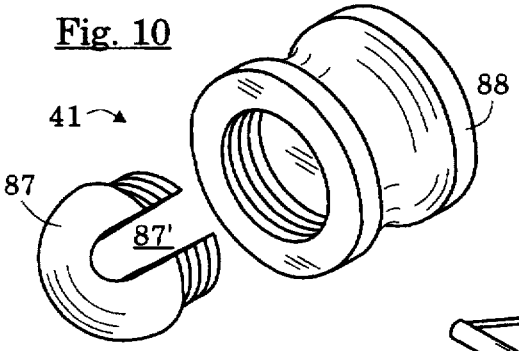
FIG. 10 is an isometric view of one embodiment of a handgrip that may be mounted to the distal end of the rope.
Figure 11:
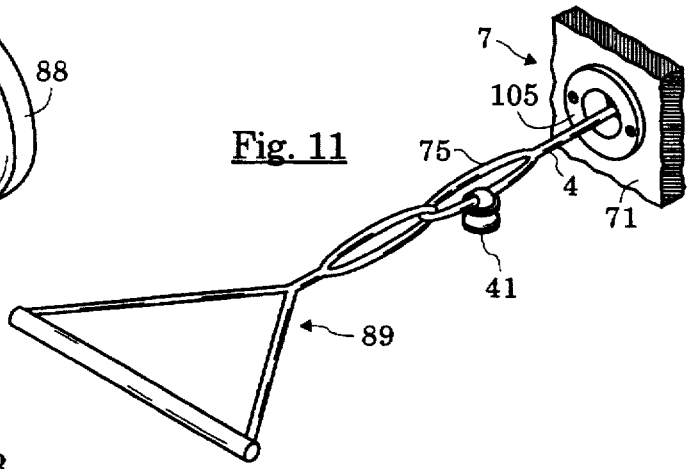
FIG. 11 is an isometric view illustrating deployment of the handgrip of FIG. 10 when a ski handle is attached to the rope.
Figure 12:
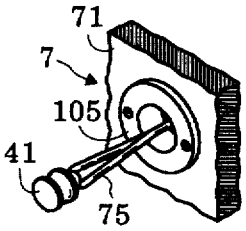
FIG. 12 is an isometric view illustrating deployment of the handgrip of FIGS. 10 and 11 on the rope as winding is almost completed, the ski handle has been removed, and the handgrip is about to be received by a hull-mounted eyelet.

Many ropes 4 are not equipped with a device that can act as stop member 40. A handgrip 41, shown in FIG. 10, may optionally be attached to the distal end of such ropes 4. Handgrip 41 is generally shaped so as to facilitate the functions of stopping complete rope retraction and providing an easily grasped structure for the initiation of rope 4 payout. Again, aperture 7 is of a form facilitating these functions (e.g., eyelet 105). In this example, handgrip 41 includes an externally threaded male portion 87 with a rope-receiving slot 87' and an internally threaded female portion 88. To assemble handgrip 41, loop 75 at the distal end of tow rope 4 is placed within slot 87' and male portion 87 is screwed into female portion 88. When assembled, handgrip 41 may loosely slide along loop 75. As shown in FIG. 11, when ski handle 89 is connected to loop 75, handgrip 41 simply hangs unobtrusively from loop 75. FIG. 12 shows eyelet 105 and handgrip 41 as winding is almost completed. Ski handle 89 has been removed from rope 4 and handgrip 41 is positioned to seat against eyelet 105. Ski handle 89 may thus be neatly stored separately.

Device 2 may alternatively be used without stop member 40 or handgrip 41, in which case ski handle 89 will prevent complete rope retraction. This requires that ski handle 89 remain attached to rope 4 when stored, or that some other means is used to prevent complete rope retraction, such as a cleat onto which loop 75 may be hooked.

Aperture 7 may optionally include a periphery-adjusting means 110 (not shown) for adjusting the periphery of aperture 7 so that knots in the line may be passed more smoothly, and for returning the periphery to a position in which member 40 or handgrip 41 abuts against the periphery as described above.

Device 2 may optionally include a switch means 112 (not shown) for automatically deactivating motor 10 upon the termination of winding. Switch means 112 may be formed by a switch mounted in eyelet 105 so as to be activated by contact with member 40 or handgrip 41.

Figure 13:
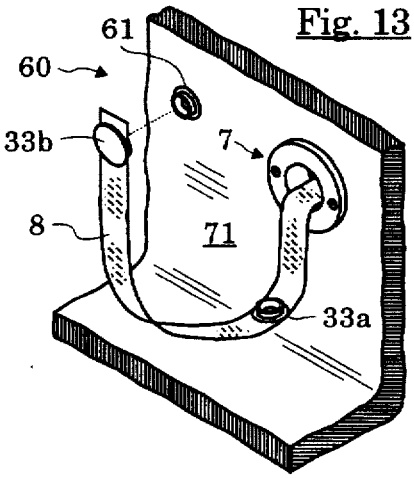
FIG. 13 is an isometric view of a portion of a boat transom, showing a favored embodiment of lead-segment-retainment means featuring a transom-mounted snap stud.

FIG. 13 illustrates a favored embodiment of a lead-segment-retainment means 60 mounted on boat B separately from spool 3. Retainment means 60 provides a structure to which lead segment 8 may be temporarily secured in an orderly manner while rope 4 is being independently used. This embodiment includes a snap stud 61 such as may be mounted on the exterior of transom wall 71, to which snap socket 33*b* mounted on lead segment 8 may be fastened. Lead segment 8 may alternatively be secured as by hooking line-engaging loop 32 to any suitable structure, such as a cleat.

Figure 14:
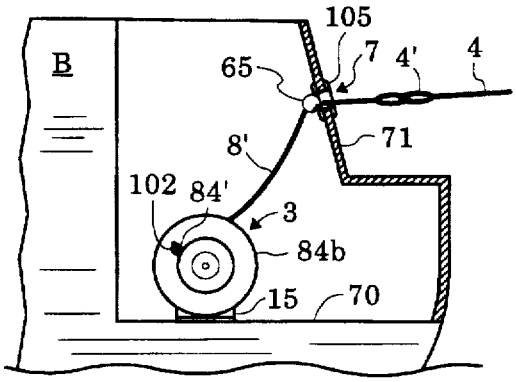
FIG. 14 is a side view of the rear of a boat with a portion of its hull cut away, showing the embodiment in which the rope remains coupled to the spool and the force of towing a skier is taken by a load-bearing member abutting against the inside periphery of a transom aperture.

FIG. 14 illustrates another embodiment of device 2, in which rope 4 is not removed from device 2 for use, but rather, remains coupled to spool 3 while a skier is being towed. Rope 4 remains attached in any normal manner to an alternative lead segment 8' that is in the form of a rope similar in nature to rope 4. This connection is able to support the tension in rope 4 due to towing of the skier, and does not necessitate quick-connect means 9. The force of towing a skier is passed to transom wall 71 by a load-bearing member 65 securely mounted onto segment 8'. As shown in FIG. 15, segment 8' may be passed through a hole in load-bearing member 65, and a knot 101 may be tied on each side of member 65 to retain it securely in place. Member 65 is of a form such that it cannot pass through aperture 7 (eyelet 105). Referring again to FIG. 14, segment 8' may be coupled to spool 3 as by passing it through a hole 84' in spool flange 84*b* (see also FIG. 2) and tying a knot 102 larger than hole 84' in its proximal end. Member 65 is positioned onto segment 8' such that the distal end of segment 8' may extend out of aperture 7 by a suitable distance according to user preference. The length of segment 8' is such that when member 65 abuts against the inner periphery of aperture 7, there remains slack in that portion of segment 8' disposed between spool 3 and member 65, thus protecting device 2 from stress. Although this embodiment is not the most favored, it still benefits from other features of device 2, such as the compact and easily assembled motor-within-hub design, slipping clutch 11, and the functional form of aperture 7. It may be preferred on boats that do not use an outboard motor and have a transom wall 71 strong enough to support the tow force at the chosen location of aperture 7.

In a different use of this embodiment of device 2, loop 4' at the near end of rope 4 is attached to hardware such as pylon 68*a* or tow ring 68*b* for skiing while remaining attached to lead segment 8'. Note also that a member 65 can be used as overstress prevention means 50 referred to earlier.

Operation of the preferred embodiment of line-handling device 2 begins with rope 4 stored onto spool 3 with stop member 40 seated against the outside periphery of aperture 7 (eyelet 105). Ski handle 89 has preferably been removed so that only member 40 presents itself outside aperture 7. Rope 4 may be deployed by first gasping member 40 and pulling a short length of rope 4 out of the hull through aperture 7. Any desired ski handle 89 may then be attached to rope 4. Rope 4 may then be pulled through aperture 7, causing rope 4 to unwind as spool 3 rotates against the mild resistance offered by slipping clutch 11. Rope 4 may be neatly deployed to a person in the water by having the person grasp ski handle 89 at a safe distance from boat B, and then slowly trolling boat B forward until payout of rope 4 is almost complete. The last portion of rope 4 may be unreeled by a passenger until segment 8 partially unwinds from spool 3 and quick-connect means 9 presents itself through aperture 7. Rope 4 may then be uncoupled from spool 3 by operating quick-connect means 9 so as to quickly and easily remove rope 4 from lead segment 8, as by unfastening snap fastener 33 to release loop 4' from the distal end of lead segment 8. Rope 4 may then be secured to any traditional towing hardware 68 and water skiing may commence. Lead segment 8 may optionally be neatly secured to lead-segment-retainment means 60, as by fastening snap socket 33b to transom-mounted stud 61.

In the event boat B is inadvertently trolled forward too far while deploying rope 4, lead segment 8 will become completely unreeled and will experience a sudden tension. Overstress-prevention means 50 will protect device 2 from damage such as by the automatic unfastening of reclosable fastening 51. In the preferred embodiment, the connected combination of rope 4 and line strap 53 will uncouple from spool strap 52 and will be left slightly behind in the water. This situation is easily remedied by retrieving line strap 53 from the water and re-assembling lead segment 8, as by suitably closing reclosable fastening 51. Such an error should very quickly teach the boat operator to stop the forward motion of boat B before lead segment 8 becomes completely unreeled.

After use, rope 4 may be stored by first removing it from towing hardware 68 and operating quick-connect means 9 to secure one end of rope 4 to lead segment 8 without the formation of a "Lark's Head in Eye" knot, as by passing the distal tip of lead segment 8 through loop 4' and closing snap fastener 33 to form line-engaging loop 32. In this manner, rope 4 may be quickly and easily coupled to spool 3. Control means C may then be used to energize motor 10, which rotates shaft 18, forcing clutch disks 24 and 25 to turn. Disks 24 and 25 frictionally urge spool 3 to rotate, first winding segment 8 and then rope 4. Rope 4 is reeled until ski handle 89 is within reach or until member 40 abuts against the periphery of aperture 7, at which time control means C is used to deactivate motor 10. The operator may then optionally remove ski handle 89 for separate storage. It may be necessary to briefly energize motor 10 again to completely seat member 40 against the periphery of aperture 7. Rope 4 may thusly be stored onto spool 3 so as to be disposed for future deployment.

The present device is not limited to the handling of ski ropes, but rather might generally be used in situations in which it is desired to independently use a line that is to be repeatedly stored on a spool that is separated or partitioned from the operator. The device allows the easy coupling and uncoupling of a line and a spool to which access would otherwise restricted or inconvenient.

The foregoing description is considered as illustrative only of the principles of the invention. Numerous modifications and alternative embodiments may occur to those of ordinary skill in the art. For example, various forms of lead segment and quick-connect means are possible, such as by using different configurations, materials, and fasteners, that achieve a similar result. A device with a different power source (e.g., a power spring) or a different clutch design would still benefit from the disclosed lead segment and quick-connect means concept allowing independent rope use. These variations fall within the scope of the invention. It is not intended to limit the scope of the invention to the particular examples set forth, but rather it is intended to cover such modifications and alternative embodiments as may be included within the spirit and scope of the invention as expressed in the appended claims.

What is claimed is:

1. A line handling device for storing a water ski line, comprising a rotatable spool, mounting means for supporting said spool within a boat having an aperture in its hull through which the line may pass, an elongated, flexible lead segment, a proximal end of said lead segment being attached to said spool such that said lead segment may be wound onto said spool, and quick connect means disposed at a distal end of said lead segment by which the line and said lead segment quickly disconnected from one another after unwinding of the line from said spool, so as to free the line for use in the towing of a water skier, said quick connect means also enabling the line in its unwound state and said lead segment to be quickly connected to one another from a location outside of the boat hull so as to position the line for winding upon said spool.

2. The line handling device of claim 1 wherein said lead segment comprises a strap.

3. The line handling device of claim 1, further comprising a motor and a slipping clutch connected between said motor and said spool.

4. The line handling device of claim 1 wherein said mounting means is of a form so as to mount said spool to a selected mount surface within the boat such that the axis of rotation of said spool is parallel to the mount surface.

5. The line handling device of claim 3 wherein said lead segment includes overstress prevention means disposed thereon for automatically protecting said spool and said mounting means from damaging stress that may occur upon complete line payout.

6. The line handling device of claim 3, further including a reclosable fastening of limited strength disposed on said lead segment such that the unfastening of said reclosable fastening causes the line to become uncoupled from said spool, said reclosable fastening being of a form such that the presence of tension in said lead segment induces a force tending to unfasten said reclosable fastening, whereby said reclosable fastening automatically unfastens in the event the tension in said lead segment becomes too high for said reclosable fastening to withstand, thereby relieving the tension in said lead segment and protecting said spool and said mounting means from damaging stress.

7. A line handling device for storing a line, comprising a rotatable spool, mounting means for supporting said spool, an elongated, flexible lead segment, a first fastening element and a second fastening element, said fastening elements being releasably fastenable to one another, a proximal end of said lead segment being attached to said spool such that said lead segment may be wound onto said spool, said first fastening element being mounted to a distal tip of said lead segment, said second fastening element being mounted to an area of said lead segment separated from the distal tip by a distance such that the joining of said fastening elements creates a loop in said lead segment of a size so as to be able to retain a loop that is disposed on the line, whereby said first fastening element may be passed through the loop that is disposed on the line and fastened to said second fastening element so as to releasably connect the line to said lead segment, said lead segment and said fastening elements enabling the line in its unwound state and said spool to be quickly coupled and uncoupled from one another at a distance from said spool.

8. The line handling device of claim 7 wherein said device is adapted for mounting within a boat having an aperture in its hull through which a water ski line may pass, said device being further adapted such that the stored line and said lead segment may be unwound from said spool by pulling the line and said lead segment out of the boat hull through the aperture until said fastening elements are positioned outside of the boat hull, whereupon said fastening elements may be unfastened to quickly disconnect the unwound line from said lead segment so as to free the line for use in the towing of a water skier, said fastening elements also enabling the unwound line and said lead segment to be quickly connected to one another from a location outside of the boat hull, so as to position the line for winding upon said spool.

9. The line handling device of claim 8 wherein said lead segment comprises a strap, and wherein said first fastening element comprises a first snap fastener element and said second fastening element comprises a second snap fastener element capable of being mated to said first snap fastener element.

10. The line handling device of claim 8, further including a reclosable fastening of limited strength disposed on said lead segment such that the unfastening of said reclosable fastening causes the line to become uncoupled from said spool, said reclosable fastening being of a form such that the presence of tension in said lead segment induces a force tending to unfasten said reclosable fastening, whereby said reclosable fastening automatically unfastens in the event the tension in said lead segment becomes too high for said reclosable fastening to withstand, thereby relieving the tension in said lead segment and protecting said spool and said mounting means from damaging stress.

11. The line handling device of claim 10 wherein said lead segment comprises a spool attached strap and a line engaging strap, a proximal end of said spool attached strap being fixed to said spool, a distal end of said line engaging strap having said fastening elements functionally disposed thereon, said straps being joined at their remaining ends by said reclosable fastening.

12. The line handling device of claim 8, further comprising a motor and a slipping clutch connected between said motor and said spool.

13. The line handling device of claim 12, further including a reclosable fastening of limited strength disposed on said lead segment such that the unfastening of said reclosable fastening causes the line to become uncoupled from said spool, said reclosable fastening being of a form such that the presence of tension in said lead segment induces a force tending to unfasten said reclosable fastening, whereby said reclosable fastening automatically unfastens in the event the tension in said lead segment becomes too high for said reclosable fastening to withstand, thereby relieving the tension in said lead segment and protecting said spool and said mounting means from damaging stress.

14. The line handling device of claim 13 wherein said lead segment comprises a strap, and wherein said first fastening element comprises a first snap fastener element and said second fastening element comprises a second snap fastener element capable of being mated to said first snap fastener element.

15. The line handling device of claim 13 wherein said lead segment comprises a spool attached strap and a line engaging strap, a proximal end of said spool attached strap being fixed to said spool, a distal end of said line engaging strap having said fastening elements functionally disposed thereon, said straps being joined at their remaining ends by said reclosable fastening.

16. The line handling device of claim 12 wherein said motor is positioned within said spool.

17. A line handling device for mounting within a boat having an aperture in its hull through which a line may pass, comprising a rotatable spool, mounting means for supporting said spool, an elongated, flexible lead segment, a first fastening element and a second fastening element, said fastening elements being releasably fastenable to one another, a proximal end of said lead segment being attached to said spool such that said lead segment may be wound onto said spool, said first fastening element being mounted to a distal tip of said lead segment, said second fastening element being mounted to an area of said lead segment separated from the distal tip by a distance such that the joining of said fastening elements creates a loop in said lead segment of a size so as to be able to retain a loop that is disposed on the line, whereby said first fastening element may be passed through the loop that is disposed on the line and fastened to said second fastening element so as to releasably connect the line to said lead segment, said lead segment and said fastening elements enabling the line in its unwound state and said spool to be quickly coupled and uncoupled from one another at a location outside of the boat hull.

18. The line handling device of claim 17 wherein said lead segment comprises a strap.

19. The line handling device of claim 17 wherein said first fastening element comprises a first snap fastener element and said second fastening element comprises a second snap fastener element capable of being mated to said first snap fastener element.

20. The line handling device of claim 17, further comprising a motor and a slipping clutch connected between said motor and said spool, and wherein said lead segment includes overstress prevention means disposed thereon for automatically protecting said spool and said mounting means from damaging stress that may occur upon complete line payout.

21. A method of managing the use of a line that is stored onto a line handling device such that a distal end of the line is accessible to an operator for grasping of the line, said device having a rotatable spool mounted so as to be inaccessible to the operator for the purpose of removing the line from said spool after unwinding of the line, said device having an elongated, flexible lead segment wound upon said spool, one end of said lead segment being connected to said spool, and a quick connect means disposed at the opposite end of said lead segment by which a proximal end of the line is removably connected to said lead segment, comprising the steps of:

pulling the line so as to cause the line to unwind from said spool until the line is fully unwound, and then causing said lead segment to partially unwind from said spool;

uncoupling the line from said spool by operating said quick connect means so as to remove the line from said lead segment;

using the line in a desired manner;

after such use, coupling the line to said spool by operating said quick connect means so as to connect a proximal end of the line to said lead segment; and rotating said spool so as to wind said lead segment onto said spool, and then so as to wind the line onto said spool such that the line is stored onto said spool so as to be disposed for future deployment.

22. A method of managing the use of a water ski tow line that is stored onto a line handling device mounted within the hull of a boat such that a distal end of the line is disposed outside of the boat hull through an aperture in the hull, said device having a rotatable spool mounted within the boat hull, an elongated, flexible lead segment wound upon said spool, one end of said lead segment being connected to said spool, and a quick connect means disposed at the opposite end of said lead segment by which a proximal end of the line is removably connected to said lead segment, comprising the steps of:

manually pulling the line out of the hull through the aperture, first causing the line to unwind from said spool until the line is fully unwound, and then causing said lead segment to partially unwind from said spool;

uncoupling the line from said spool by operating said quick connect means so as to remove the line from said lead segment;

fastening the line to the boat in any manner desired and using the line to tow a water skier;

after such use, unfastening the line from the boat and coupling the line to said spool by operating said quick connect means so as to connect a proximal end of the line to said lead segment; and rotating said spool so as to wind said lead segment onto said spool, and then so as to wind the line onto said spool such that the line is stored onto said spool so as to be disposed for future deployment.

* * * * *